United States Patent [19]

Lindner et al.

[11] 4,266,411

[45] May 12, 1981

[54] METHOD AND MACHINE FOR FORMING PLUSH-LOOP WARP KNIT FABRIC

[75] Inventors: Heinz Lindner; Fritz Stopp, both of Geyer; Wolfgang Georgie, Tannenberg; Werner Oehm, Geyer; Lisbet Müller, Tannenberg; Brigitte Graubner, Geyer, all of German Democratic Rep.

[73] Assignee: Veb Wirkmaschinenbau Karl-Marx-Stadt, Karl-Marx-Stadt, German Democratic Rep.

[21] Appl. No.: 84,805

[22] Filed: Oct. 15, 1979

[51] Int. Cl.[3] ..... D04B 23/06

[52] U.S. Cl. ..... 66/84 R; 66/203

[58] Field of Search ..... 66/84 R, 85 R, 203, 66/109, 214

[56] References Cited

U.S. PATENT DOCUMENTS

| | | | |
|---|---|---|---|
| 3,707,853 | 1/1973 | Lindner et al. | 66/84 R |
| 3,913,355 | 10/1975 | Lindner | 66/84 R |
| 4,031,717 | 6/1977 | Lindner et al. | 66/84 R |
| 4,089,191 | 5/1978 | Lindner | 66/84 R |
| 4,126,019 | 11/1978 | Lindner et al. | 66/84 R |

FOREIGN PATENT DOCUMENTS

| | | | |
|---|---|---|---|
| 135515 | 5/1979 | Fed. Rep. of Germany | 66/84 |
| 136986 | 8/1979 | Fed. Rep. of Germany | 66/85 R |

*Primary Examiner*—Ronald Feldbaum

*Attorney, Agent, or Firm*—Michael J. Striker

[57] ABSTRACT

A warp knit machine produces patterned plush-loop warp knit fabric and includes a row of hooked needles, a pillar bar for forming interlaced adjoining chains of the ground fabric and an inlay bar for laying inlay thread into the ground fabric. Each needle has a set of pile-thread guiders swingably mounted between non-selected and selected position. A guide comb structure comprises a row of blades defining first inter-blade gaps alternating with second inter-blade gaps. All pile threads are guided through the first gaps, but the selected pile threads differently located in the gaps. During certain phases of operation, the needles extend through the second gaps, and also a row of pile-thread-laying sinkers pass through the second gaps. The guide-comb structure is shogged to overlap selected pile threads, which the pile-thread sinkers then lay into the needle hooks. Also, the guide-comb structure is so configured that it underlaps the non-selected pile threads beneath the needles.

7 Claims, 8 Drawing Figures

METHOD AND MACHINE FOR FORMING PLUSH-LOOP WARP KNIT FABRIC

BACKGROUND OF THE INVENTION

The present invention can be employed for producing jacquard-patterned plush-loop warp knit fabric of the type having a pillar-and-inlay ground-fabric structure, with one set of pile threads per wale, a selected pile thread of each pile-thread set being tied into the ground fabric in the form of a loop and furthermore forming a plush loop, with the non-selected pile threads of the set being tied into the fabric as mere walewise-running unlooped threads.

The present invention concerns warp knitting machines, especially but not exclusively chrochet-galoon machines, of the type which typically comprise one row of knitting needles, a pillar bar for converting knitting laps into interlaced adjoining wales, an inlay bar for laying at least one inlay thread into the ground fabric, plural pile-thread guiders per needle, means for laying selected pile threads into needle hooks, means for under-lapping the non-selected pile threads, and a row of plush bars alternating with the knitting needles, as well as methods of operating such machines.

German Democratic Republic Pat. No. 110,073 discloses a machine of the type just outlined. In that machine, use is made of a row of multiple-eyelet pile-thread guiders, each pile-thread guider guiding a different pile thread through each of its multiple eyelets. The row of multiple-eyelet pile-thread guiders can be shogged and can be lowered into the spaces intermediate the needles once per each two knit courses, the eyelets being oriented approximately parallel to the longitudinal direction of the needles. Associated with each multiple-eyelet pile-thread guider is a respective selector member which has an open throat facing the row of needles. Depending upon which of the pile threads guided through the multiple-eyelet guiders are to be selected at a particular point in a pattern, the selector members move to different positions associated with different ones of the eyelets. The selector members serve to actually lay the selected pile threads into the hooks of the needles.

That machine is capable of high-productivity manufacture of plush-loop warp knit fabric, when extreme fineness of fabric is not involved. However, when use is to be made of the almost untwisted synthetic threads so desired for use as the pile threads of such a fabric, and especially when a considerable number of pile thread is involved in the set of pile threads associated with each needle, faulty operation tends to occur with regard to selection of particular pile threads for appearance in the visible pile pattern and also at those locations where the needles, when driven out to extended position, pass through the associated set of pile threads. The result is either a fault in the pattern or even loss of proper interlacing, which leads to poor quality especially when greater-fineness fabric with a larger number of pile threads per pile-thread set is to be produced.

SUMMARY OF THE INVENTION

Accordingly, it is a general object of the invention to be able to produce jacquard-patterned plush-loop warp knit fabrics of the general type discussed above of high quality, even when high levels of fineness and/or a large number of pile threads in the pile-thread pattern are involved.

On the level of implementation, it is a general object of the invention to keep the non-patterning and patterning pile threads separate from each other, in a highly positive and reliable manner, during all of the various phases of machine operation. This includes positive and definite separation of the pile thread selected for patterning from the non-patterning pile threads of its associated set at the time of pile-thread selection; reliable under-lapping of the non-selected pile threads beneath the associated needle, with no possibility at all that the needle fail to pass over the set of non-selected pile threads, or split into the set of non-selected threads, or fan them out, or otherwise improperly engage them; with the selected pile thread being kept separated from the non-selected threads as the needle is driven out to extended position between the non-selected and selected threads; with the needle not improperly or prematurely snagging the selected pile thread; and with the selected pile thread positively and reliably positioned preliminary to its being laid into the open hook of the needle.

In the presently embodiment of the invention, use is made of a guide comb structure comprising a row of guide comb blades defining first inter-blade gaps and also second inter-blade gaps which alternate with the first inter-blade gaps. Each set of pile threads, both selected and non-selected, is guided through a respective first gap. The first gaps are closed off at the ends thereof nearer the cast-off location of the needles, and the non-selected pile-threads extend from the non-selected pile-thread guiders to the fabric at the closed-off ends of the first gaps. The lower edge of the guide comb structure, about which the non-selected pile threads are reflcted on their way into the fabric, has a height, in one elevation of the adjustable-elevation guide comb structure, below the needles, so that when the latter are driven out the guide comb structure itself keeps the non-selected threads in undelapped position. The selected pile thread, on the other hand, due to its pile-thread guider being in selected position, is differently located in the respective first gap of the guide comb structure, at a point of deflection located more forwardly and above that of the non-selected pile threads, to facilitate passage of the needle between the non-selected pile threads, on the one hand, and, on the other hand, the selected pile thread. The lower face of the guide comb structure is inclined relative to the longitudinal direction of the needles, being increasingly spaced therefrom in the direction from cast-off to yarn-taking position of the needles, to facilitate forwards shifting of the point of deflection of the selected pile thread against the bottom edge of a blade of the guide comb when its pile-thread guider moves to selected position. The guide comb structure performs a shogging motion, to overlap the selected pile threads above the needles. The upper face of the guide comb structure has an orientation such that it is approximately perpendicular to the direction in which the non-selected pile threads extend from their associated, non-selected pile-thread guiders through the guide comb structure into the fabric. In this way, when the guide comb structure performs a shogging motion to overlap the selected pile threads, there is a minimum tendency for the non-selected pile threads to shift along the upper edges of the guide comb blades, fan out from one another, or the like. During at least part of the motion of the needles from cast-off to extended position, the needles pass through the aforementioned second inter-blade gaps of the guide comb structure, in a way which, firstly and as already stated, keeps the underlapped portions of the non-selected pile threads very positively below the level of the needles and, secondly, walls off the out-driven needle from the portions of the non-selected threads which extend through the first inter-blade gaps; additionally, at such time, the lower and upper faces of the guide comb structue act to very positively space the overlapped portion of the selected pile thread from the underlapped portions of the non-selected pile threads, to create a sort of passage which the needle can extend without any possibility of snagging any portions of these threads. In the preferred embodiment, the second inter-needle gaps are additionally used as spaces through which the pile-thread-laying members of a pile-thread-laying bar can pass, when the overlapped selected pile threads are actually to be laid into the open hooks of the fully extended needles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
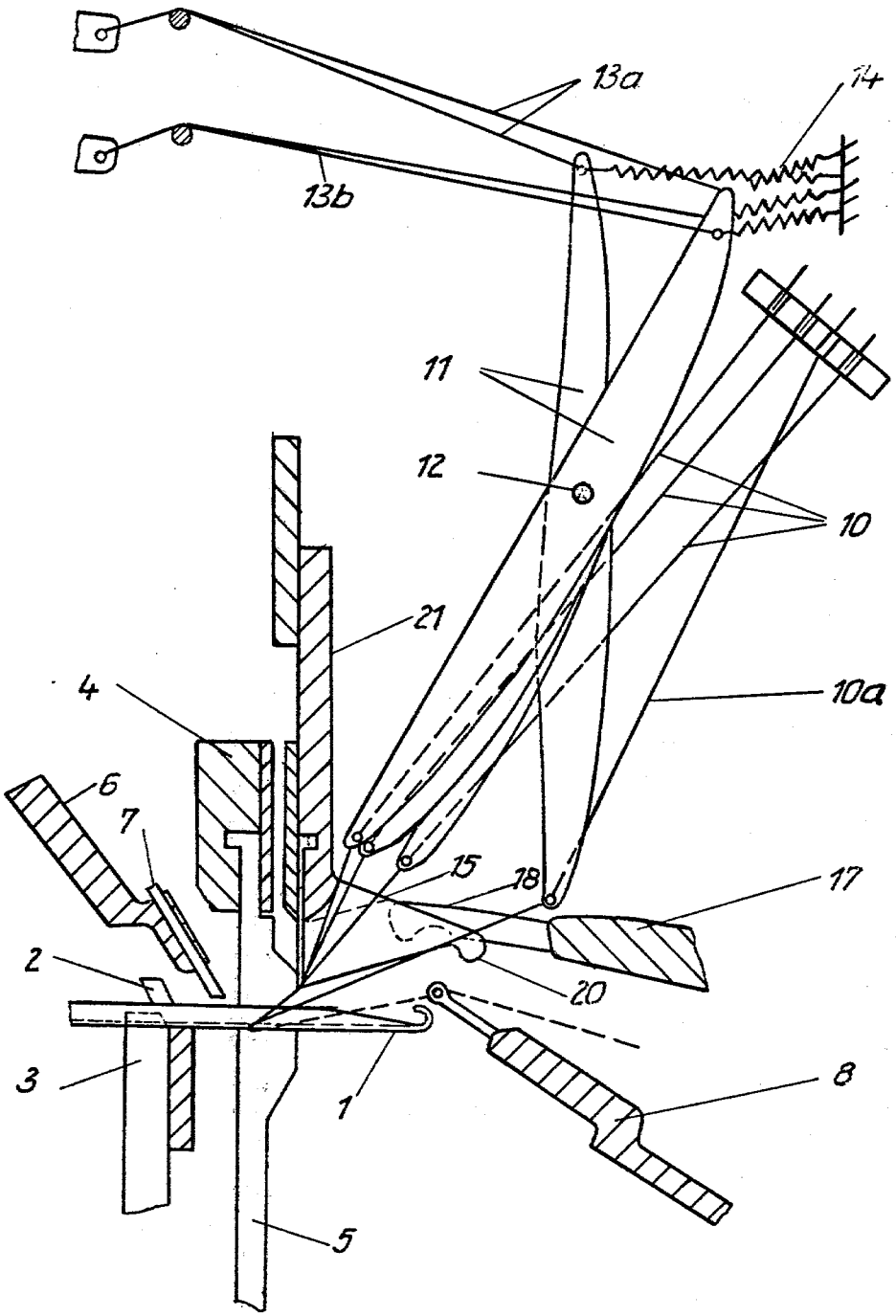
FIG. 1 is a vertical section through a warp knitting machine in accordance with the invention, taken in the loop-forming zone thereof.

The exemplary warp knitting machine depicted comprises one row of horizontally shifted slide needles 1 provided with controlled hook-closing slides 2. The slide needles 1 are guided in a cast-off bar 3 and, when driven out to extended position, interdigitate with a row of plush bars 5. The plush bars 5, at their upper ends, are secured to a stationary mounting bar 4. During knitting, plush loops from around the large-cross-section zones of plush bars 5 and then, as knitting of further courses proceeds, the plush loops shift downwards onto the smaller-cross-section zones of the plush bars 5, finally dropping off the (non-illustated) lower free ends of the plush bars.

Located back of the row of plush bars 5 is an inlay bar 6 provided with inlay-thread guide tubes 7. The inlay bar 6 and inlay-thread guide tubes 7 serve to lay inlay thread into a conventional pillar-and-inlay ground fabric structure. The links or chains of the ground fabric are produced by a pillar bar 8 with lap guide blades 9 operative during each course of knitting for converting knitting laps into new chain stitch pillars.

Associated with each needle 1 is a respective set of four individually pivotable pile-thread guiders 11, pivoted about a stationary, horizontally extending pivot shaft 12. The pile threads associated with one such set of four pile-thread guiders 11 are denoted by numeral 10. There is one set of four such guiders 11 per interneedle interval or needle space of the row of needles 1. The pile-thread guiders 11 are individually selectable by means of respective pull cords 13*a*, 13*b*, etc., which when pulled swing the respective guiders 11 against the action of respective tension springs 14.

To guide the pile threads 10 in the region between the eyelets of pile-thread guiders 11 and the loop-forming zone of the machine, there is provided a guide comb structure 15. As shown most clearly in FIG. 4, guide comb 15 comprises a succession of bifurcated members 20. First, narrower gaps 16 are defined intermediate the two prongs of each such bifurcated member 20. Second, wider gaps 19 are defined intermediate neighboring bifurcated members 20. The pile threads 10 are guided through the narrower, first gaps 16. During certain phases of knitting operation, the slide needles 1 pass through the wider, second gaps 19.

Registering with the wider, second gaps 19 of the guide comb 15 are the pile-thread-laying sinkers 18 of a pile-thread-laying bar 17. In the exemplary embodiment illustrated, the guide comb 15 and the pile-thread-laying bar 17 are shogged, leftwards or rightwards, always in unison, e.g., by virtue of a common carrier structure for both; however, the guide comb 15 and the pile-thread-laying bar 17 can be vertically raised and lowered independently of each other.

Figure 3:
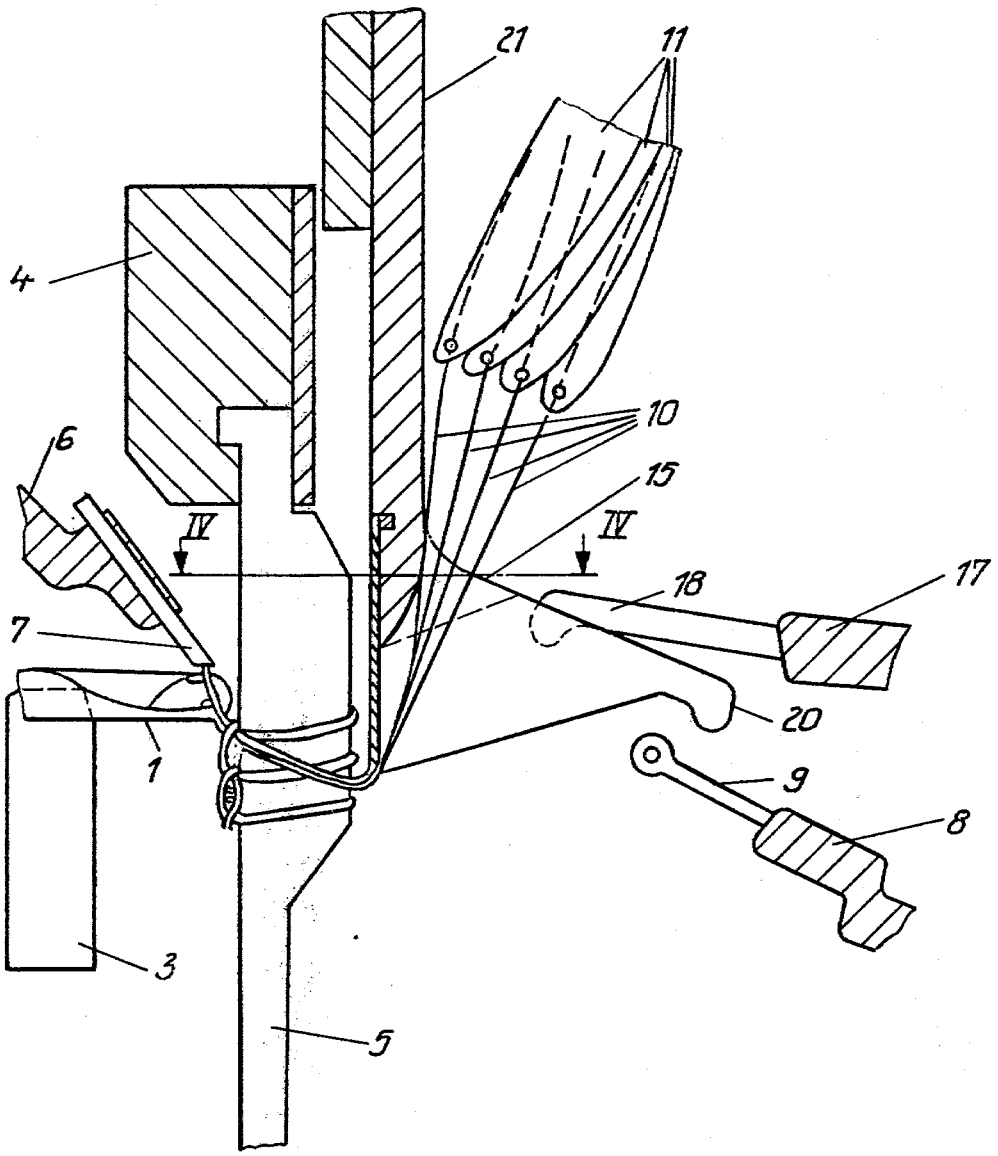
FIG. 3, 5 and 7 are cross-sections similar to FIG. 1, taken at three different points in the cycle of operation of the machine, along section lines III—III, V—V and VII—VII of FIGS. 4, 6 and 8.

The guide comb 15 has a back face, i.e., facing towards the cast-off location, which is perpendicular to the general plane defined by the row of needles 1 and located just in front of the row of plush bars 5. The lowermost edge of the guide comb 15 is horizontal and extends in the same direction that successive needles 1 are spaced from one another. As shown in FIG. 3, pile threads 10 which have not been selected for appearance in the visible pile pattern extend up from the knitted fabric, deflected across this lower edge of guide comb 15, and from there extend rather directly to the eyelets of their respective pile-thread guiders 11.

As shown in FIG. 1, and various other Figures, the upper edges of the bifurcated members 20 of the guide comb 15 are inclined. In particular, they are so inclined as to extend approximately perpendicular to the direction in which the non-selected pile threads 10 extend from the eye-lets of their guiders 11 to the lowermost edge of guide comb 15. In this way, when guide comb 15 is shogged leftwards or rightwards, the non-selected pile threads 10 are drawn across the upper edges of the comb blades 20 substantially perpendicular to these upper edges, so as to experience a minimal tendency to slip forwards along these upper edges, e.g., towards the free ends of the guide comb blades 20.

The lower edges of the blades 20 of guide comb 15 extend upwardly inclined away from the direction of needle travel. As shown in FIG. 1, when a particular pile thread 10*a* is selected, its guider 11 is swung forwards, thereby causing the point of engagement between the selected pile thread 10*a* and the lower edge of the blades 20 of guide comb 15 to shift forwards; the inclination of the lower edges of the guide comb blade 20 facilitates this forwards shift of the point of engagement with the selected pile thread 10*a*.

The bifurcated elements 20 of guide comb 15 are conveniently mounted in a bar 21.

The pile-thread guiders 11 are moved between selected and non-selected position under the control of a jacquard mechanism. In the illustrated embodiment, however, the pull cords 13*a*, 13*b*, etc., for the pile-thread guiders 11 are not directly connected to such a jacquard mechanism, but instead are connected to a latching system controlled by the jacquard mechanism. The latching system assumes latched settings in response to each patterning command issued by the jacquard mechanism, and then stays in latched position independently of the jacquard mechanism until the next issuance of a patterning command by the jacquard mechanism. This buffer-storage action allows a greater time interval for the jacquard mechanism to advance from one patterning command setting to the next without any possibility of effect upon the pile-thread guiders 11 during such transitional jacquard-mechanism advancements; this is of particular advantage when high-speed jacquard-mechanism operation is involved.

Figure 2:
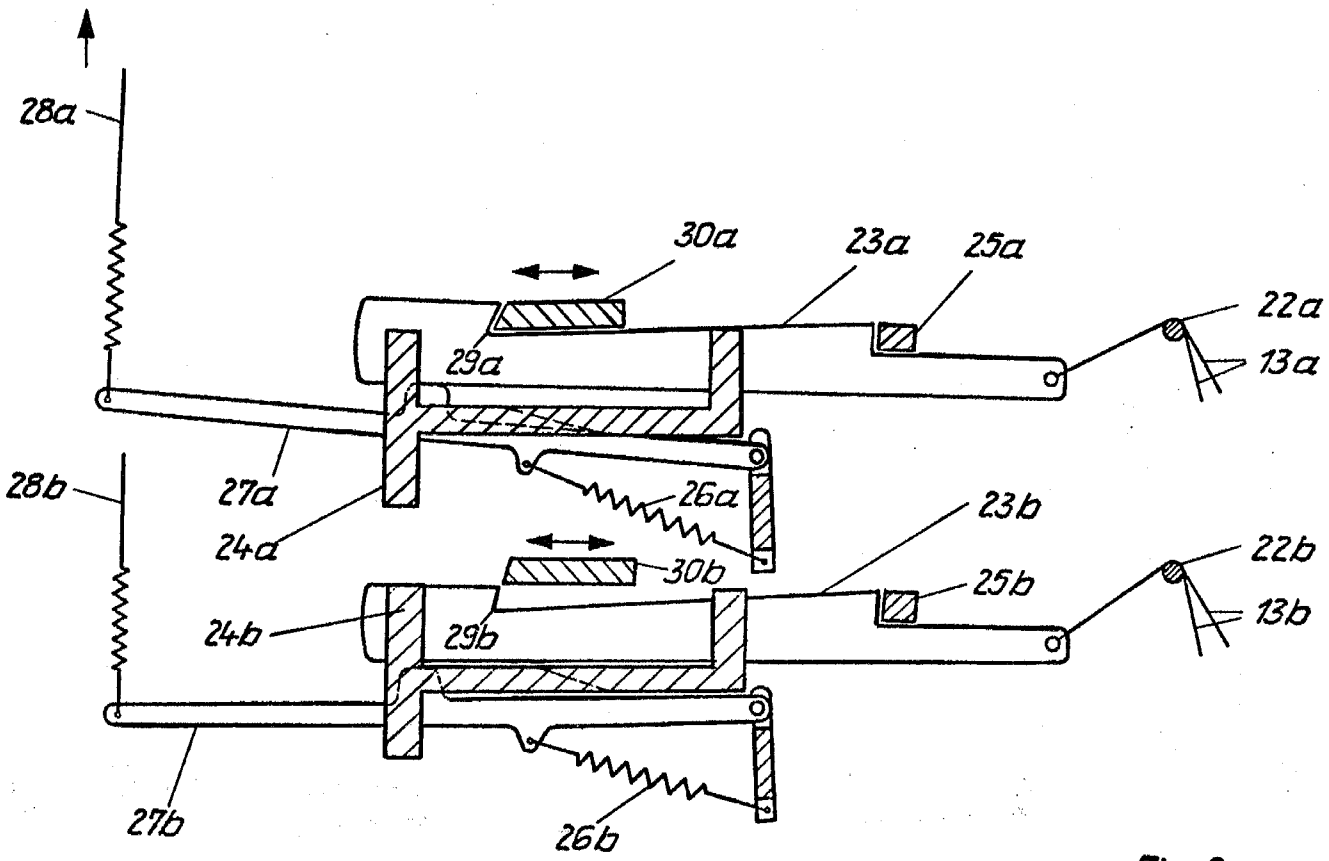
FIG. 2 is a vertical section through an intermediate pattern command storage which registers pattern commands by latching action during intervals intermediate issuance of successive patterning commands.

FIG. 2 depicts the intermediate buffer-storage system for patterning commands. As shown, the control mechanisms for the pull cords 13*a*, 13*b*, etc., associated with each wale are stacked vertically one above the other. Pull cord 13*a* travels over a stationary horizontal shaft 22*a* and is fastened to the forwards end of a plate 23*a* guided in a stationary guide bar 24. As shown for plate 23*b* of FIG. 2, when the plate 23 is in its inoperative setting it is pulled rightwards against a stationary stop member 25 by the associated tension spring 14 (FIG. 1) and additionally rests with its own weight on the stationary guide bar 24. Beneath each plate 23 there is located a lever 27 pivoted at its forward end and biased counterclockwise by a respective spring 26 and connected at its rearward end to a jacquard-mechanism harness cord 28. Each plate 23 is furthermore provided with an undercut recess 29. Associated with the plates 23 are bevelled bars 30 whose rearward faces are complementary to the undercuts of recesses 29. As indicated by the double-headed arrows in FIG. 2, the bevelled bars reciprocate horizontally, in the direction of elongation of the plates 23. When, for example, the pile thread associated with pull cord 13*b* is to be moved to selected position, the jacquard-mechanism harness cord 28*b* is pulled, swinging lever 27*b* clockwise, an upwardly projecting nose on lever 27*b* lifting plate 23 upwards into the operative vicinity of horizontally reciprocating bevelled bar 30*b*. As soon as bar 30*b*, during its rearward (in FIG. 2 leftward) stroke engages into the undercut recess 29*b* of plate 23*b*, plate 23*b* becomes latched and thereafter independent of the jacquard-mechanism harness cord 28*b*. As the rearward stroke of bar 30*b* is performed, plate 30*b* is pulled rearward away from stop member 25*b* in opposition to the associated one of the tension springs 14 (FIG. 1) and the associated one of the pile-thread guiders 11 is swung out to selected position. When thereafter bar 30*b* performs its forwards stroke, bar 30*b* unlatches from plate 23*b* and if plate 23*b* is not again to be selected it drops down of its own weight onto the stationary guide bar 24*b*.

Figure 4:
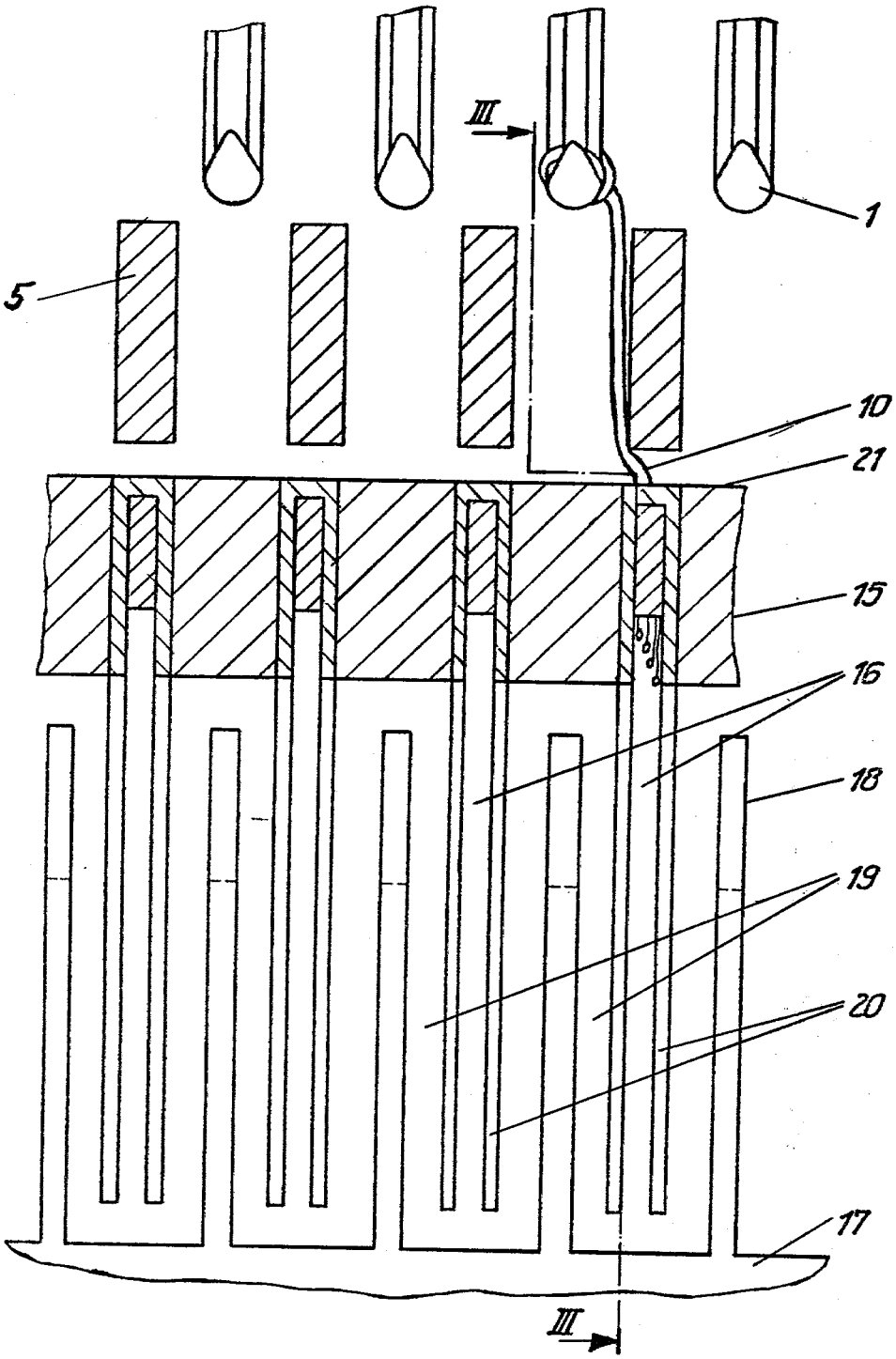
FIGS. 4, 6 and 8 are horizontal sections taken along section lines IV—IV, VI—VI and VIII—VIII of FIGS. 3, 5 and 7.

The illustrated knitting machine operates as follows:

(1) The slide needles 1 are located in cast-off position, and the inlay bar 6 is shogged by a predetermined number of needle spaces, so as to underlap inlay yarn beneath a predetermined number of needles, i.e., so that when the slide needles 1 are subsequently driven out to extended position they will pass above the just laid inlay yarn. The motions which inlay bar 6 performs in the process of laying inlay yarn are conventional, and will be familiar to persons skilled in the art. FIGS. 3 and 4 depict the positions of other elements of the machine, at the time that inlay bar 6 is shogged.

(2) At the instant depicted in FIGS. 3 and 4, all the pile-thread guiders 11 are shown in non-selected position. In FIG. 3, three plush loops, formed from the previously selected one of the pile threads during previous courses, are shown looped around the large-cross-section zone of a plush bar 5; during continued knitting, they will of course shift down onto the small-cross-section zone of plush bar 5, and eventually drop off the lower (non-illustrated) end of plush bar 5.

(3) In FIG. 3, with all four pile-yarn guiders 11 in non-selected position, the four pile threads 10 extend out from the fabric, alongside the left face of a plush bar 5 (as also shown in FIG. 4), and up through guide comb 15 to their respective guiders 11. In particular, and as shown in FIG. 4, the four pile threads 10 are deflected upwards around the lowermost face of guide comb 15 (as clearly shown in FIG. 3), and then up between the two prongs of one of the forked elements 20 of guide comb 15 (as clearly shown in FIG. 4).

Figure 5:
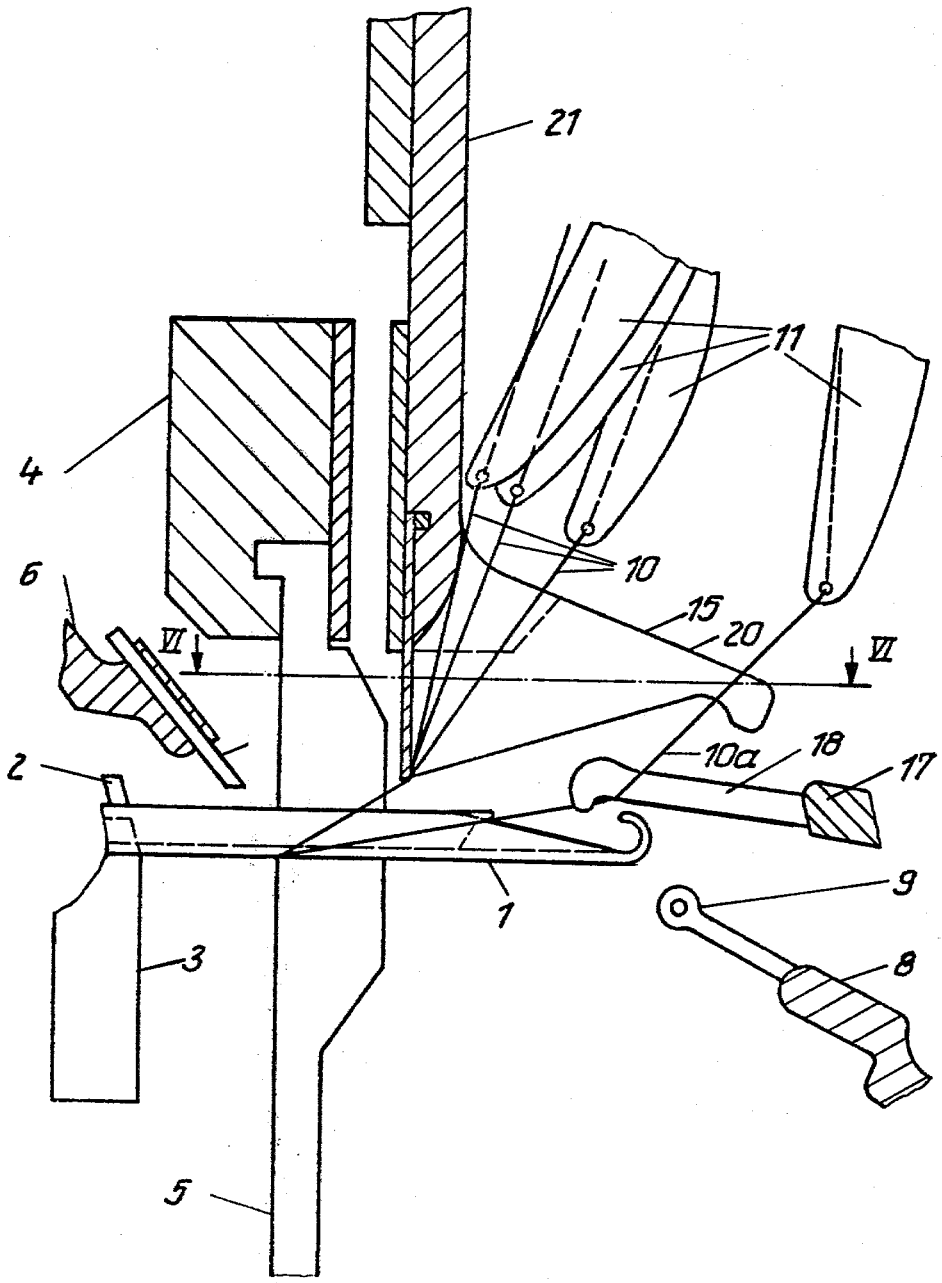

(4) The guider 11 of the selected pile thread 10*a* is displaced to selected position. (The selected position of this guider 11 is shown in FIG. 5, but it is noted that, at this point of the operation, the other components of the machine are not yet in the positions shown in FIG. 5.)

(5) Next, the guide comb 15 and the pile-thread laying bar 17 are shogged leftwards in unison with each other, to a position one needle space to the left of the position shown in FIG. 4.

(6) As a result of the one-needle-space leftwards shog of comb 15 and bar 17, the three non-selected and non-patterning pile threads are underlapping beneath slide needle 1, i.e., such that when needle 1 is driven out to extended position it will pass above the three non-selected and non-patterning pile threads and therefore have no chance of catching these non-selected pile threads in is hook.

(7) Concurrently with the one-needle-space leftwards shog of comb 15 and bar 17, the needles 1 begin to be driven out towards extended position. They pass over the inlay yarns and likewise pass over the non-selected pile threads. During the one-needle-space leftwards shog, the comb 15 stays at the elevation shown in FIG. 3, until somewhat before the needles 1 have been driven out to an extent where they would be located in the path of shogging motion of comb 15. With the comb 15 at the elevation depicted in FIG. 3 as the needles 1 begin to be driven out, the non-patterning pile threads are very positively and definitely held below the level of the underfaces of the needles 1, so as to positively and absolutely preclude snagging of the non-selected pile threads by the needles 1.

By the time that the needles 1 have been extended so far that they have entered into the path of shogging motion of comb 15, the one-needle-space leftwards shog of comb 15 (and of bar 17 which is shogged in unison with comb 15) will have already been completed.

(8) Guide comb 15 is now to continue its leftwards shog for another 1.5 needle spaces. However, because the needles 1 are now or about to be located in the path of shogging motion of guide comb 15, comb 15 is first raised up to above thelevel of the needles 1, to the elevation depicted in FIG. 5. (At this point of operation, other machine components are not yet in the positions depicted in FIG. 5.) With guide comb 15 now raised to the FIG. 5 elevation thereof, the aforementioned further 1.5-needle-space leftwards shog of comb 15 is performed, at the completion of which the guide comb 15 and bar 17 are in the position shown in FIG. 5, i.e., a total of 2.5 needle spaces to the left of the position they occupied in FIG. 4.

(9) In the next step of operation, the pillar bar 8 performs an overlap shog followed by a swingback (here a swingdown), to lay the new pillar chain laps over the throats of the open needles 1. The laps fed from guide blades 9, and the upwards motion of the pillar bar overlap shog and the downwards motion of the swingback are not illustrated, because so familiar and conventional. During the overlap shog and swingback of the pillar bar 8, the pile-thread-laying bar 17 with its pile-thread-laying sinkers 18 are still at the elevation relative to the needles 1 depicted in FIG. 3, so that the pile-thread-laying sinkers 18 do not interfere with the overlap shog and swingback of the lap guide blades 9.

Figure 6:
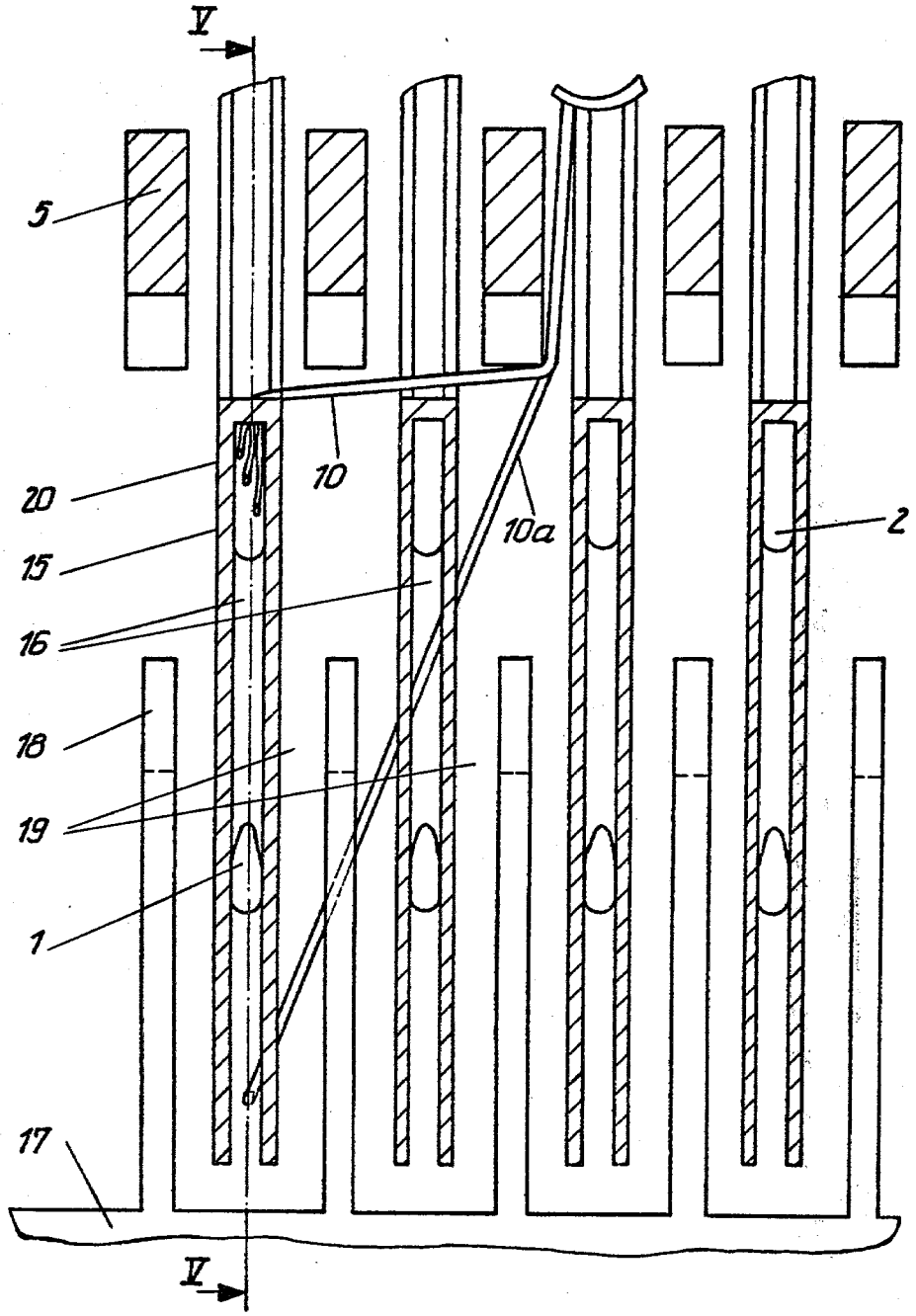

(10) Next, with the guide comb 15 at the elevation depicted in FIG. 5, the pile-thread-laying bar 17 is lowered to the elevation depicted in FIG. 5, thereby laying the selected pile thread 10*a* across the open throat of a needle 1. In each of FIGS. 4, 6 and 8, one and the same needle is marked with an "X", to facilitate visulization, and likewise one and the same bifurcated element 20 of guide comb 15 is marked with a "Y" in each of these Figures. As shown in FIG. 6, with the guide comb 15 and pile-thread-laying bar 17 shifted 2.5 needle spaces leftward relative to their FIG. 4 position, the lowering of the pile-thread-laying bar 17 serves to lay the selected pile thread 10*a* across the open throat of, in particular, the needle located to the immediate left of the one marked with an "X".

(11) Next, the needles 1 begin to retract back to cast-off position. Both a selected pile thread and also the lap of a chain pillar knitting thread have been inserted into each needle hook, and accordingly both these threads are together formed into a loop. Because of the presence of the plush bar 5, the pile thread 10*a*, during retraction of the needle 1, forms an enlarged pile loop around the plush bar 5 (refer back to FIG. 3). The lap of knitting thread from lap guide blade 9, on the other hand, serves to tie the inlay thread into the ground fabric (in accordance with conventional pillar-and-inlay ground-fabric construction), and furthermore serves to tie the non-selected pile threads 10 into the ground fabric in the form of mere walewise-running unlooped threads.

(12) Next, with the needles 1 back at cast-off position, the inlay bar 6 is once more shogged, although now in the opposite direction, to underlap another run of inlay thread. One course has been completed, and the next course is about to be produced.

(13) Simultaneous with the underlapping of this next run of inlay thread, the guide comb 15 is shogged, now rightwards, by 2.5 needle spaces, back to the orignial position of FIG. 4; the bar 17 likewise returns to the position of FIG. 4, inasmuch as it is shogged in unison with guide comb 15. The next driving out of the needles 1 to extended position, i.e., for formation of the second course, is about to begin.

(14) As in the case of the first course, already described, the guide comb 15 is initially at low elevation as the needles 1 being to be driven out, to very positively keep the non-patterning pile threads 10 beneath the level of the outcoming needles, to guarantee underlap and furthermore prevent snagging.

Figure 7:
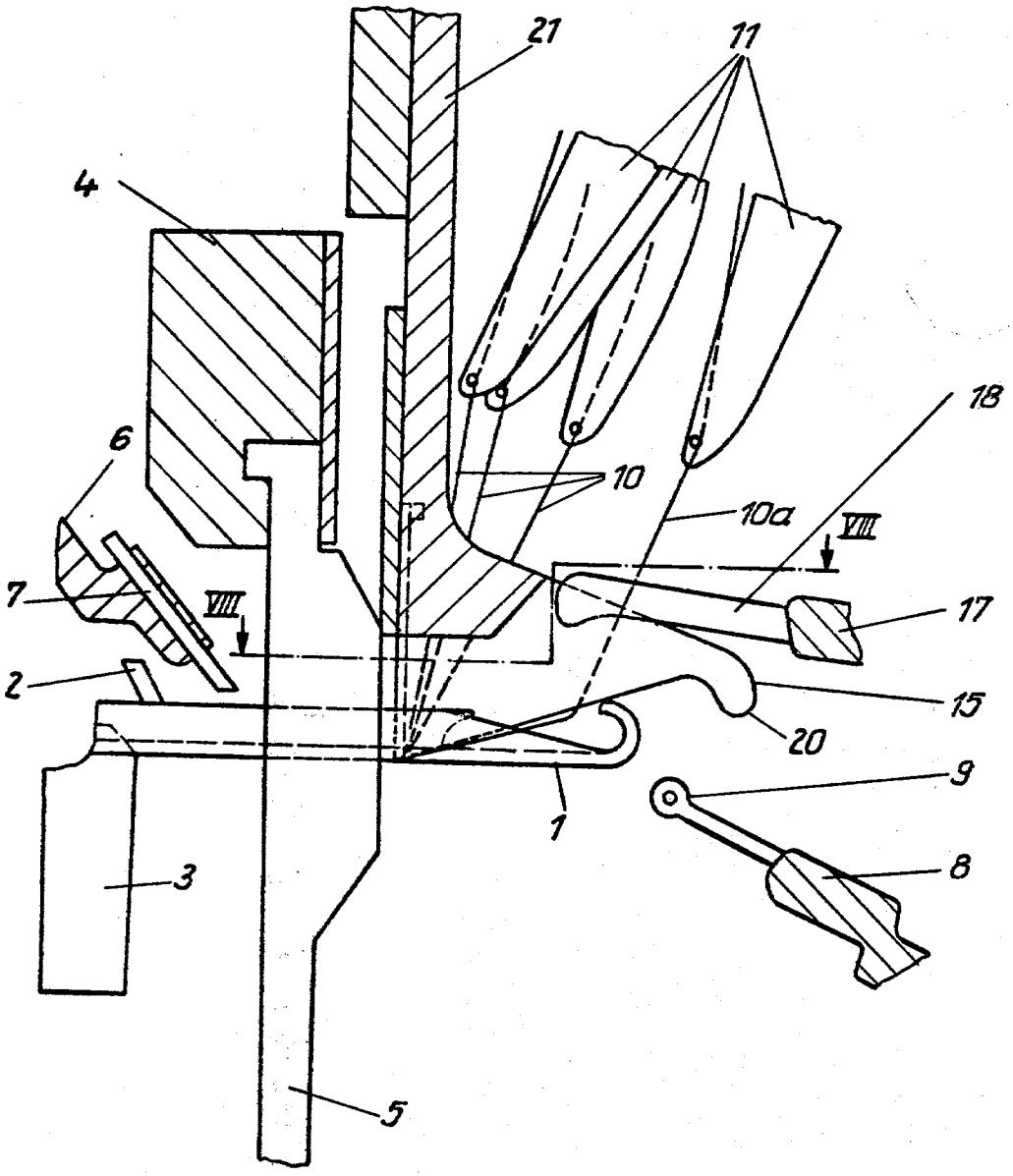

(15) As the needles 1 are driven out part of the way to fully extended position, the guide comb 15 is raised a limited distance, such that the needle 1, which passes over the non-patterning pile threads 10, will pass beneath the patterning pile thread 10*a*, This somewhat raised elevation of guide comb 15 is shown in FIG. 7. As also shown in FIG. 7, the selected pile thread 10*a*, which is guided between the two prongs of one of the bifurcated elements 20 of guide comb 15 (see also FIG. 8), extends up from the guide comb 15 at a part of the lower edge thereof considerably more forwards than the non-selected pile threads 10.

(16) The pillar bar 8 performs an overlap shog and then a swingdown movement to lay the new knitting-thread laps, i.e., for the second course, across the open throats of the needles 1. As shown in FIG. 7, the pile-thread-laying bar 17 is, at this time, in elevated position, so as not to interfere with the operation of pillar bar 8.

(17) For the sake of explanation, it is assumed that, after this second course is completed, the presently patterning pile thread 10*a* is to cease to be a patterning pile thread. During this time the guider 11 for presently patterning pile thread 10*a* begins to swing back, but relatively slowly, towards its non-selected position.

(18) When the needles 1, during the formation of the second course, have reached fully extended position, the guide comb 15 is lowered, thereby laying the presently patterning pile thread 10*a* across the throat of an open needle 1. As will be seen from FIG. 8, during this second course of knitting, the presently patterning pile thread 10*a* is laid down by guide comb 15 across the throat of the needle marked with the "X", whereas during the preceding, first course of knitting, the pile thread 10*a* was laid by the pile-thread-laying bar 17 across the throat of the needle to the immediate left of the one marked with the "X".

Figure 8:
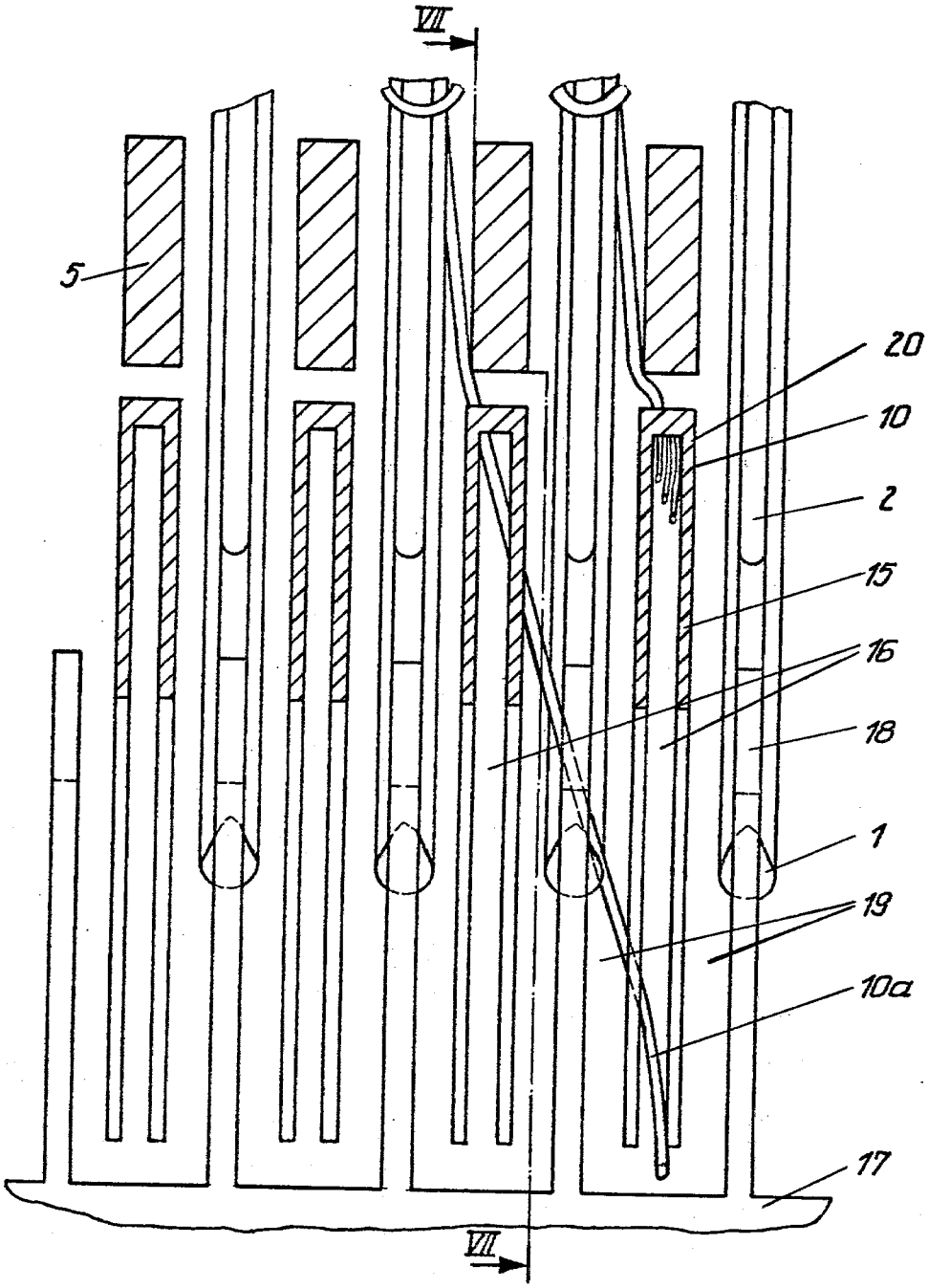

(19) When now the needles 1 retract back towards cast-off position, the hook of the needle 1 is holding both a chain pillar lap and also the presently patterning pile thread 10*a*, which are together formed into a loop, the pile thread 10*a* becoming wrapped around the same plush bar 5 around which it was wrapped during the preceding, first course, but, as can be seen from a comparison of FIGS. 6 and 8, wrapped therearound now in the direction opposite to that in which it was wrapped during the first course.

(20) All components are now back in the positions which they had in FIGS. 3 and 4, and the next cycle of operation, involving the next two courses, is ready to begin, e.g., with a different one of the pile threads 10 now selected for appearance in the fabric's visible pile pattern, or perhaps with an interval without piling.

From the foregoing, the following will be noted: The non-patterning pile threads are never engaged by needle hooks; instead they are always confined to one wale, namely that of the needle marked with the "X", and they run walewise along the length of this wale tied into the ground fabric but never actually looped. In contrast, the patterning pile thread 10*a*, during the first (or odd-numbered course) is laid across the needle of one wale by the pile-thread-laying bar 18 and looped into that wale, and then during the second (or even-numbered course) is laid across the needle of the wale to the immediate left of the first-course wale by the guide comb 15 itself and looped into that neighbor-to-the-left wale. Thus, during a longer succession of courses involving a particular pile thread selected for patterning, the patterning pile thread is alternately looped into alternate ones of two adjoining wales, becoming wrapped around an associated plush bar 5 in one direction during one course and then being wrapped around the same plush bar 5 in the opposite direction during the next course, and so forth.

It will be understood that each of the elements described above, or two or more together, may also find a useful application in other types of constructions differing from the types described above.

While the invention has been illustrated and described as embodied in the context of a warp knitting machine operating in a particular manner to produce plush fabric, it is not intended to be limited to the details shown, since various modifications and structural changes may be made without departing in any way from the spirit of the present invention.

Thus, for example, instead of the control levers 27*a*, 27*b*, etc., of FIG. 2, use could instead be made of respective electromagnets energized and deenergized in accordance with an electronic or electrical pattern-control system.

Likewise, it will be understood that various modifications of the particular knitting cycle described above could be made. For example, in the embodiment described above, the pile-thread-laying bar 17 is always shogged in unison with the guide comb 15, e.g., by virtue of being mounted on a common carrier structure. However, the amplitude and timing of the pile-thread-laying bar 17 could be so designed that it need not share the shogging motion of guide comb 15, i.e., by always being located outside the path of shogging motion of guide comb 15 when the latter is to be shogged.

Similarly, in the embodiment described above, the guide comb 15 not only maintains the requisite forms of separation as between patterning and non-patterning pile threads but furthermore, during the formation of alternate courses, is itself responsible for laying the patterning pile threads into the open throats of the extended needles, this being done in the other courses by the pile-thread-laying bar 17 with its pile-thread-laying sinkers 18. However, it will be appreciated that the system could be so designed that the pile-thread-laying bar 17 be responsible for laying the patterning pile threads into the open throats of the extended needles during each and every course of the fabric.

Without further analysis, the foregoing will so fully reveal the gist of the present invention that others can, by applying current knowledge, readily adapt it for various applications without omitting features that, from the standpoint of prior art, fairly constitute essential characteristic of the genreic or specific aspects of this invention.

What is claimed as new and desired to be protected by Letters Patent is set forth in the appended claims.

1. In a warp knitting machine operative for producing patterned plush-loop warp knit fabric, in combination, means for forming a ground fabric, including a row of hooked knitting needles, means cooperating with the knitting needles for feeding knitting thread onto the needles and forming the interlaced adjacent wales of a ground fabric, and means for inlaying inlay thread into the ground fabric; a row of plush bars located intermediate adjoining needles; a respective set of pile-thread guiders for each needle of the row of needles, the pile-thread guiders of each such set being individually displaceable between a non-selected position and a selected position; and a guide-comb structure operative for maintaining separation between the pile threads of selected pile-thread guiders and the pile threads of non-selected pile-thread guiders, the guide comb structure being mounted for shogging motion in the direction in which successive needles of the needle row are spaced one from the next and also for lifting and lowering motion in a direction generally perpendicular to the general plane defined by the row of needles, the guide-comb structure having a series of blades defining first inter-blade gaps alternating with second inter-blade gaps, the first inter-blade gaps serving to guide pile threads from the pile-thread guiders to the fabric produced, the guide-comb structure being so located relative to the row of needles and relative to the selected and non-selected positions or the pile-thread guiders that non-selected pile threads pass through the first inter-blade gaps at one location in the first gaps whereas the selected pile threads pass through the first inter-blade gaps at another location in the first gaps, the knitting needles when moving from cast-off to extended position passing through the second gaps of the guide-comb structure; and a pile-thread-laying bar provided with pile-thread-laying members mounted to pass through the inter-blade gaps of the guide comb structure and lay the selected pile threads into the hooks of the needles.

2. The machine defined in claim 1, the pile-thread-laying members passing through the second inter-blade gaps of the guide comb structure.

3. The machine defined in claim 1, the first inter-blade gaps being closed at the ends thereof closer to the cast-off location of the needles.

4. The machine defined in claim 1, the pile-thread guiders being located at the front side of the needles and pivotally mounted about a pivot axis located in front of the breasts of the needles.

5. The machine defined in claim 3, the guide-comb structure having a generally three sided profile, the side facing the cast-off location of the needles being located immediately in front of the plush bars, a further side of the guide-comb structure being inclined at an angle such that the non-patterning pile threads extend generally normal to such further side, and pile-thread-laying side which is inclined relative to the general plane defined by the row of needles and of increasing distance from such general plane proceeding in the direction from the cast-off location to the thread-taking location of the needles.

6. The machine defined in claim 1, the pile-thread guiders each being provided with a biasing spring urging the respective pile-thread guider to a predetermined one of its positions, furthermore including patterning means operative for urging selected pile-thread guiders to their other positions.

7. The machine defined in claim 6, the patterning means including means operative for receiving patterning commands and persistently registering the patterning commands during the intervals between successive patterning commands.

* * * * *